US007445003B2

(12) United States Patent
Smith

(10) Patent No.: US 7,445,003 B2
(45) Date of Patent: Nov. 4, 2008

(54) OSCILLATING BALL THROWING MACHINE

(75) Inventor: Philip Smith, Monterey Park, CA (US)

(73) Assignee: Lob-ster Inc., North Hollywood, CA (US)

( * ) Notice: Subject to any disclaimer, the term of this patent is extended or adjusted under 35 U.S.C. 154(b) by 319 days.

(21) Appl. No.: 11/284,661

(22) Filed: Nov. 22, 2005

(65) Prior Publication Data

US 2006/0137672 A1 Jun. 29, 2006

Related U.S. Application Data

(60) Provisional application No. 60/633,128, filed on Dec. 3, 2004.

(51) Int. Cl.
*F41B 4/00* (2006.01)

(52) U.S. Cl. ..... 124/78

(58) Field of Classification Search ..... 124/6, 124/78, 81

See application file for complete search history.

(56) References Cited

U.S. PATENT DOCUMENTS

| | | | | |
|---|---|---|---|---|
| 4,027,646 | A | 6/1977 | Sweeton | |
| 4,086,903 | A | 5/1978 | Scott | |
| 4,325,351 | A | 4/1982 | Yuasa | |
| 4,442,823 | A | 4/1984 | Floyd et al. | |
| 4,570,607 | A | 2/1986 | Stokes | |
| 4,699,378 | A | 10/1987 | Sung | |
| 5,125,653 | A | 6/1992 | Kovacs et al. | |
| 5,178,123 | A | 1/1993 | Yeh | |
| 5,437,261 | A | 8/1995 | Paulson et al. | |
| 5,607,151 | A | 3/1997 | Daley | |
| 5,979,426 | A | 11/1999 | Troklus et al. | |
| 6,082,350 | A | 7/2000 | Crews et al. | |
| 6,152,126 | A | 11/2000 | Smith et al. | |
| 6,237,583 | B1 * | 5/2001 | Ripley et al. | 124/78 |
| 6,415,782 | B1 * | 7/2002 | Holland | 124/78 |
| 6,443,140 | B1 | 9/2002 | Crews et al. | |
| 6,470,873 | B2 | 10/2002 | Battersby et al. | |
| 6,739,325 | B1 | 5/2004 | Paulson | |
| 2001/0018912 | A1 | 9/2001 | Battersby et al. | |
| 2002/0023634 | A1 | 2/2002 | Caldwell | |
| 2002/0134367 | A1 | 9/2002 | Delso | |
| 2002/0148455 | A1 | 10/2002 | Trajkovic et al. | |
| 2003/0116151 | A1 | 6/2003 | Wijtkiewicz | |
| 2003/0195061 | A1 | 10/2003 | Brown | |
| 2005/0103319 | A1 * | 5/2005 | Hudson et al. | 124/78 |

OTHER PUBLICATIONS http://mastersports.com/princeprodigy.html.
http://playmatetennismachines.com/genie.htm.
http://members.aol.com/NPerry3089/playmatecat.html.

* cited by examiner

*Primary Examiner*—John Ricci
(74) *Attorney, Agent, or Firm*—Lerner, David, Littenberg, Krumholz & Mentlik, LLP

(57) ABSTRACT

A ball throwing machine for throwing projectiles, such as tennis balls or baseballs, includes a yoke assembly for projecting balls and a motor assembly for providing both nominal vertical throwing as well as oscillating vertical movement of the yoke assembly. The machine provides fine variations in the vertical trajectories of the balls being thrown and preferably eliminates the need for complicated electronic circuit controls and/or mechanical components.

18 Claims, 7 Drawing Sheets

OSCILLATING BALL THROWING MACHINE

CROSS-REFERENCE TO RELATED APPLICATIONS

This application claims the benefit of the filing date of U.S. Provisional Patent Application No. 60/633,128 filed Dec. 3, 2004, the disclosure of which is hereby incorporated herein by reference.

BACKGROUND OF THE INVENTION

The present invention relates to ball throwing machines, and more particularly, to ball throwing machines that allow for both variations in throwing distance, as well as in throwing direction.

Many athletes utilize ball throwing or projecting machines to practice their particular sport. For example, tennis ball throwing machines are extremely useful practice tools for tennis players. Typically, these machines are loaded with tennis balls and placed at an end of a tennis court which is opposite from the practicing player. The desired trajectory of the ball is usually set, either manually by the player or with the aid of a remote control. Balls are then lobbed or shot out of the machine towards the player, to allow practice shots to be hit. Such machines can project tennis balls or other types of balls (such as baseballs) by utilizing pneumatic power and/or rotating wheels to grasp the balls and project them outwardly.

As ball throwing machines have been utilized throughout the tennis industry for many years now, there have been improvements over time. Most notably, higher end tennis ball throwing machines have been provided with more ways to control to the trajectory of the projected tennis balls. For instance, certain higher end machines have been designed to allow for left and right, as well as up and down throwing variations. Typically, however, this is achieved through complicated electronic circuitry and/or complicated mechanical components.

Although these improved throwing direction variations are desirable for more realistic practice, the construction of these devices often makes them expensive to manufacture and therefore expensive for the consumer. In addition, providing electronic motor controls can be difficult to implement and accurately control. Therefore, there exists a need for a less expensive and more simplified alternative to providing increased control over directional varying ball throwing machines.

SUMMARY OF THE INVENTION

The present invention includes an improved ball throwing machine that allows for both the varying and setting of a nominal vertical throwing adjustment, as well as fine oscillation adjustments with respect to this nominal throwing angle. In accordance with certain embodiments of the present invention, a ball throwing machine is provided which preferably utilizes a motor assembly in conjunction with a linkage or cam assembly to achieve the aforementioned setting of the nominal vertical throwing adjustment and oscillation with respect to same.

A first aspect of the present invention is a ball throwing machine. One embodiment ball throwing according to this first aspect preferably includes a vertically movable yoke assembly for throwing balls at different vertical throwing angles and a motor assembly mechanically coupled to the yoke assembly for vertically moving the yoke assembly. In certain preferred embodiments, the motor assembly may include a first motor, a second motor and a linkage assembly connecting the first and second motors to the yoke assembly. Further, the first motor may be capable of vertically moving the yoke assembly to a nominal throwing angle and the second motor may be capable of vertically oscillating the yoke assembly in both positive and negative directions from this nominal throwing angle.

In other embodiments in accordance with this first aspect of the present invention, the ball throwing machine may further include means for throwing balls from the ball throwing machine. In certain embodiments, these means may include at least two rotating wheels or a pneumatic cannon. Additionally, the yoke assembly may further include a chute for feeding balls to the means for throwing balls, which may be coupled to a hopper for storing a plurality of balls and feeding balls to the chute. With regard to the linkage assembly, in certain embodiments, the assembly may also include first and second linkage portions, and an offset cam connected to one of the first and second linkage portions. Preferably, operation of the second motor rotates the cam to provide the oscillation of the yoke assembly in both positive and negative directions from the nominal throwing angle. The operation of the second motor may include rotating a drive shaft in a single direction. In certain preferred embodiments, the operation of the second motor is capable of oscillating the yoke assembly between a range of plus and minus two degrees from the nominal throwing angle. Finally, the ball throwing machine may further include means for moving the yoke assembly in left and right directions, which may be a third motor.

A second aspect of the present invention is a tennis ball throwing machine. One embodiment of this tennis ball throwing machine may include a yoke assembly having means for throwing tennis balls, at least one cam coupled to the yoke assembly, a first motor coupled to the yoke assembly for rotating the yoke assembly to a nominal throwing angle, and a second motor coupled to the at least one cam for oscillating the yoke assembly in a vertical direction from the nominal throwing angle.

Yet another embodiment tennis ball throwing machine preferably includes a housing having an opening sized to allow tennis balls to pass therethrough, a hopper connected to the housing, the hopper being capable of feeding tennis balls into the housing, a yoke assembly located in the housing, the yoke assembly including means for throwing tennis balls from the tennis ball throwing machine, and a motor assembly adapted to vertically move the yoke assembly with respect to the housing. The motor assembly may also include a first motor, a first linkage mechanism connected to the first motor, a cam connected to the first linkage mechanism, a second linkage mechanism connected to the cam and the yoke assembly, and a second motor connected to the cam and the second linkage mechanism. Preferably, operation of the first motor is capable of vertically moving the yoke assembly to a nominal throwing angle and operation of the second motor is capable of vertically oscillating the yoke assembly in both positive and negative directions with respect to the nominal throwing angle.

Another aspect of the present invention is a method of throwing balls. Preferably, the method according to this aspect includes the steps of providing a ball throwing machine having a movable yoke assembly a motor assembly, operating a first motor to move the yoke assembly to a nominal throwing angle, operating a second motor to oscillate the yoke assembly in both positive and negative directions with respect to the nominal throwing angle and throwing balls from the ball throwing machine. The operation of the second motor may include rotating a drive shaft in a single direction.

The method may also include the step of rotating the yoke assembly in left and right directions. In addition, the operation of the second motor may include rotating an offset shaped cam to oscillate the yoke assembly between a range of plus and minus two degrees from the nominal throwing angle.

BRIEF DESCRIPTION OF THE DRAWINGS

A more complete appreciation of the subject matter of the present invention and the various advantages thereof can be realized by reference to the following detailed description in which reference is made to the accompanying drawings in which.

DETAILED DESCRIPTION

Figure 1:
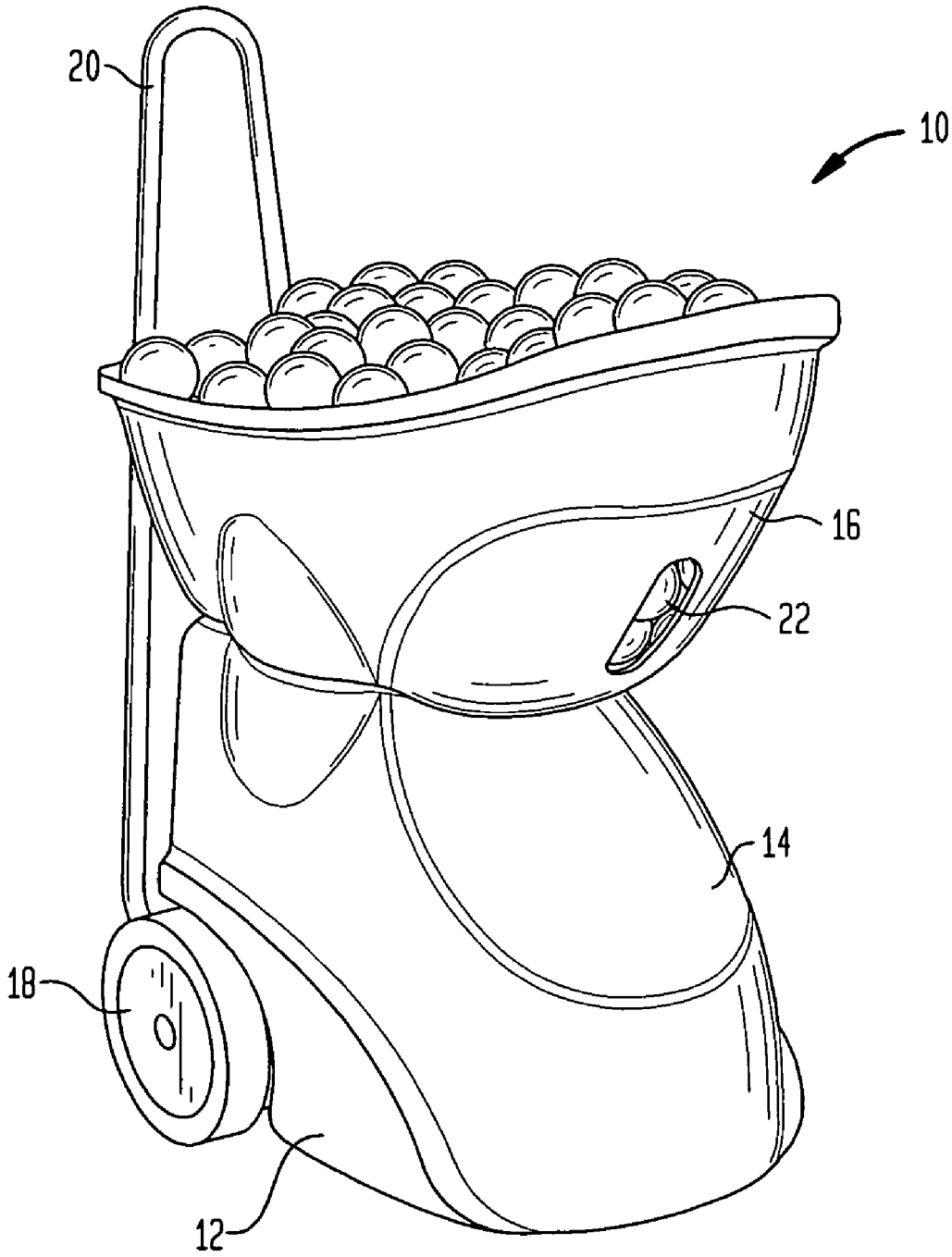
FIG. 1 is a perspective view of a ball throwing machine assembly.

Referring to the drawings, wherein like reference numerals represent like elements, there is shown in FIG. 1, in accordance with one preferred embodiment of the present invention, a ball throwing machine, generally designated by reference numeral 10. As will be discussed further below, the improved ball throwing machine 10 of the present invention allows for the setting of a nominal vertical throwing adjustment, as well as fine oscillation adjustments with respect to this nominal throwing angle. In accordance with the present invention, machine 10 preferably utilizes a motor assembly in conjunction with a linkage or cam assembly to achieve this operation, as will be described in more detail below.

Ball throwing machine 10, in the example depicted in the figures, is designed to throw tennis balls and preferably includes a main housing 12, which holds and protects the majority of the mechanical and/or electrical components of the machine, a projection opening 14 formed in housing 12, a hopper 16, wheels 18 (only one of which can be seen in FIG. 1) and a handle 20. As mentioned above, housing 12 is preferably adapted to encompass and protect many of the inner components of machine 10, of which certain of these components will be discussed more fully below. As is also shown in FIG. 1, projection opening 14 is an elongated opening extending through housing 12. Opening 14 is preferably sized and configured to allow for the projection of tennis balls therethrough over a wide range of trajectories.

Hopper 16 is a bin-like container which has an open top suitable for holding a large amount of tennis balls, such as upwards of 150 tennis balls. However, hopper 16 can be sized and configured to house any number of balls. The cooperation of hopper 16 with housing 12 allows for balls situated within its open top to be gravity fed into the housing. In certain embodiments, hopper 16 can be adapted to be removed from housing 12 and configured to be draped over the housing when in an inverted position. Thus, machine 10 may be reduced in size and further protected upon the situation of hopper 16 in this fashion. In addition, hopper 16 preferably includes an indicator cut-out 22, which allows for a user to visually recognize the level of balls located in hopper 16 from a distance, such as from across the tennis court. Wheels 18 and handle 20 are preferably provided to make machine 10 more easily moveable. Preferably, wheels 18 are oversized wheels which allow for transport of machine 10 over varying terrains. Additionally, handle 20 is preferably removable thereby further aiding in the reduction of size and easy storage of machine 10 when not in use.

Remaining FIGS. 2-7 depict various inner components of ball throwing machine 10. These inner components are sized and configured to throw tennis balls in this preferred embodiment. However, it should be realized that the components may be modified in order to throw other types of balls or projectiles such as softballs or baseballs.

As shown in FIGS. 2-7, ball throwing machine 10 further includes a yoke assembly 24 for controlling the trajectory of balls that are thrown from machine 10. Preferably, yoke assembly 24 is adapted to vary both the up and down trajectory of a ball projected from machine 10, and thus, for example, the depth of a shot on the tennis court, as well as left and right trajectory, and thus, for example, the delivery of a forehand and backhand shot to a tennis player.

In order to achieve left and right directional variation, yoke assembly 24 is preferably rotatably mounted on a base 26 and operatively connected to a motor (not shown) to facilitate rotation. A bearing 28 or the like may be placed between yoke assembly 24 and base 26 to ensure smooth rotation. In addition to a central pivot point 30, a wheel assembly 32 may be employed to ensure smooth rotation of yoke assembly 24. Wheel assembly 32 is preferably adapted to move along an arcuate path thereby aiding in the smooth pivoting of yoke assembly 24. It is also noted that other ways for rotating yoke assembly 24 can be provided.

Figure 2:
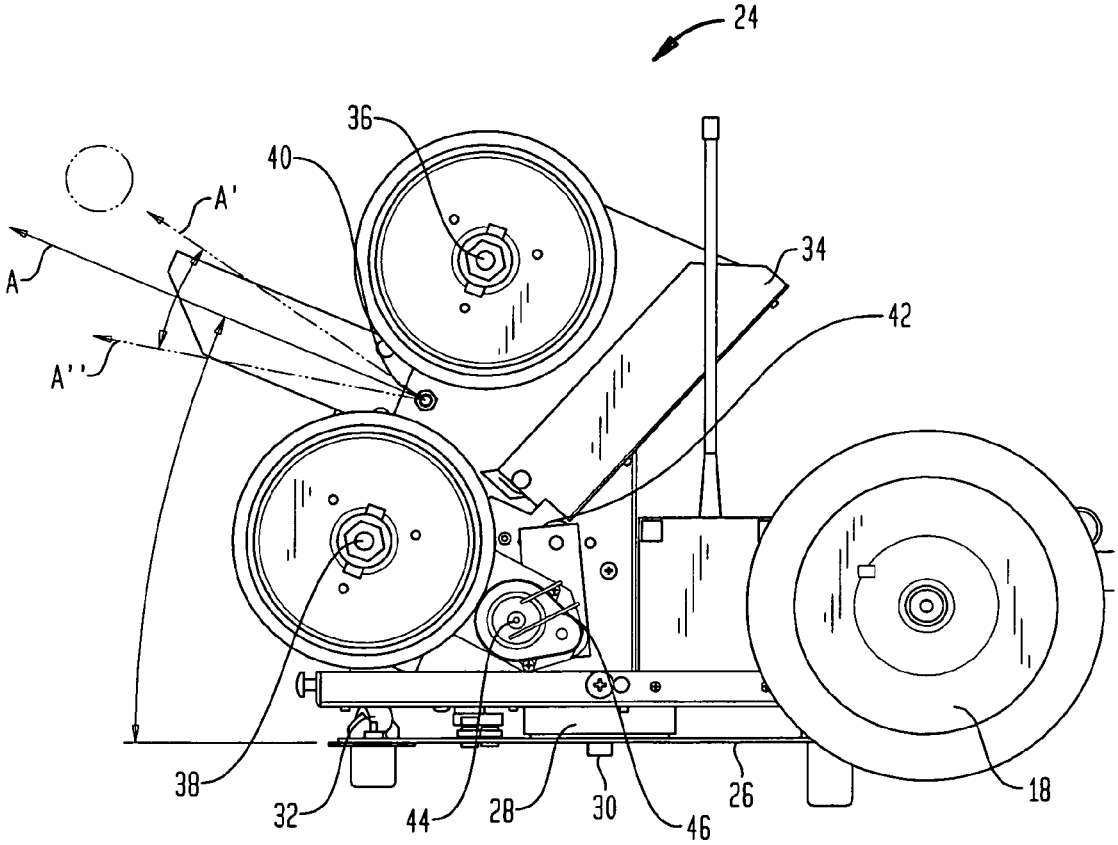
FIG. 2 is a right side cut-away view of a ball throwing machine shown in FIG. 1.
Figure 3:
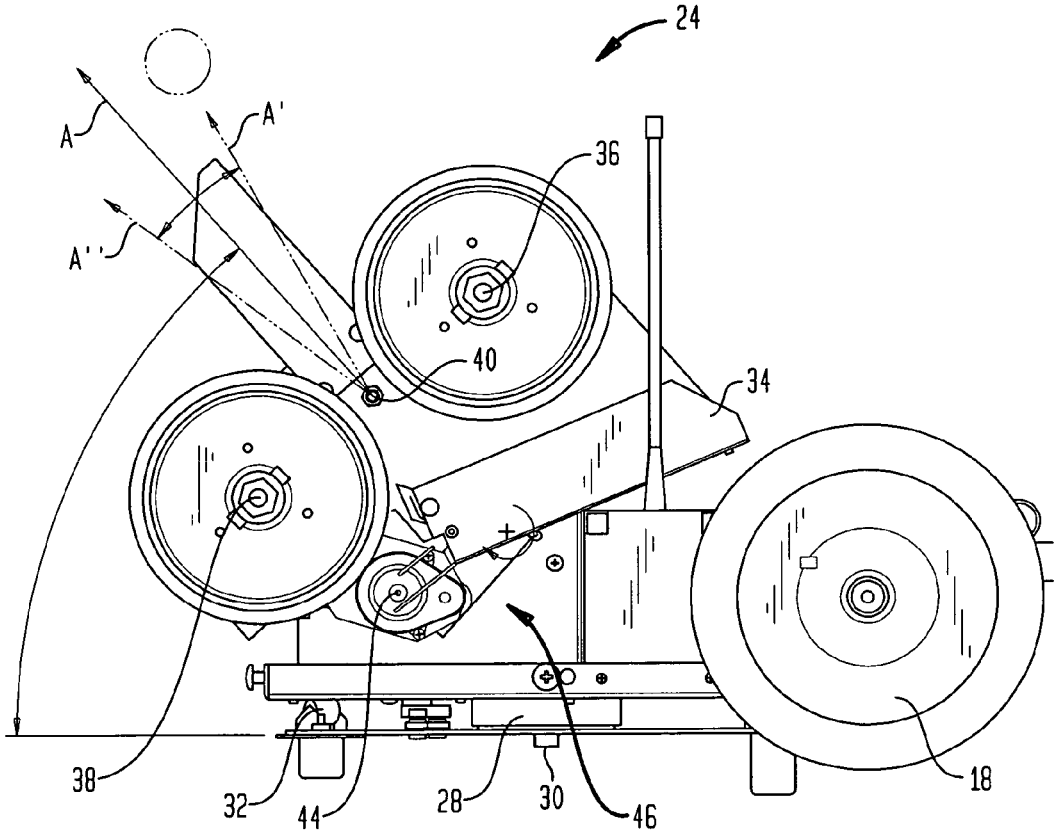
FIG. 3 is another right side cut-away view of the ball throwing machine shown in FIG. 1 showing an increased nominal throwing angle setting from that shown in FIG. 2.

As shown in particular in FIGS. 2 and 3, yoke assembly 24 is comprised of a ball feed chute 34 and throwing wheels 36 and 38. Ball feed chute 34 is preferably configured and designed to feed balls which are gravity fed from hopper 16 to throwing wheels 36 and 38. Throwing wheels 36 and 38 are preferably adapted to be rotated by individual motors (not shown) such that tennis balls introduced therebetween by ball feed chute 34 or the like are projected outwardly in a direction shown by arrow A. Such rotating wheels design is well known in the art of ball throwing machines. For example, U.S. Pat. Nos. 4,086,903 and 5,125,653, the disclosures of which are hereby incorporated herein by reference, describe ball throwing machines of this type. However, wheel designs are only one way of projecting balls outwardly in the direction shown by arrow A and other devices for projecting tennis balls can be utilized in accordance with the present invention. For example, a pneumatic device for projecting tennis balls could be incorporated in accordance with the present invention. Such pneumatic designs are also well known, one of which is described in U.S. Pat. No. 4,570,607, the disclosure of which is hereby incorporated herein by reference.

In order to achieve the aforementioned up and down directional throwing variation, yoke assembly 24 is preferably adapted to pivot about a pivot point labeled with reference numeral 40 (FIGS. 2 and 3) through the operation of a motor assembly including at least a first motor 42, a second motor 44 and a cam or linkage assembly 46. In the preferred embodiment depicted in the figures, pivot point 40 allows for yoke assembly 24 to pivot about an axis which is in a perpendicular plane to the axis about which yoke assembly 24 pivots in the above described left and right directional variation (e.g., about pivot point 30). As explained below, the present invention provides an improved ball throwing machine by use of the cooperation and configuration of first motor 42, second motor 44 and cam assembly 46 in order to provide both a nominal vertical throwing adjustment as well as fine oscillation adjustments with respect to this nominal throwing angle.

Figure 4:
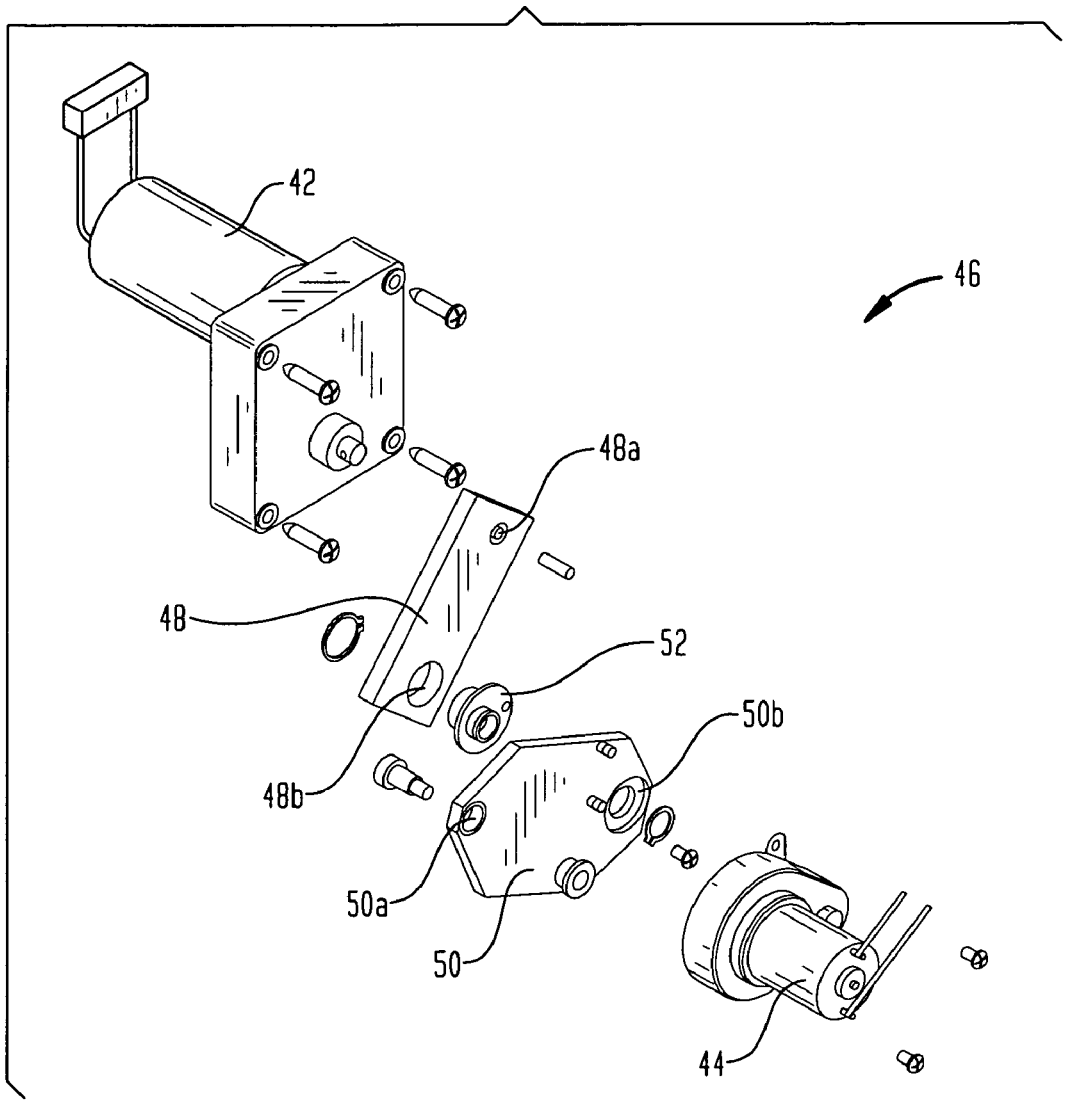
FIG. 4 is an exploded perspective view of an oscillating motor assembly for use in the ball throwing machine shown in FIG. 1.
Figure 5:
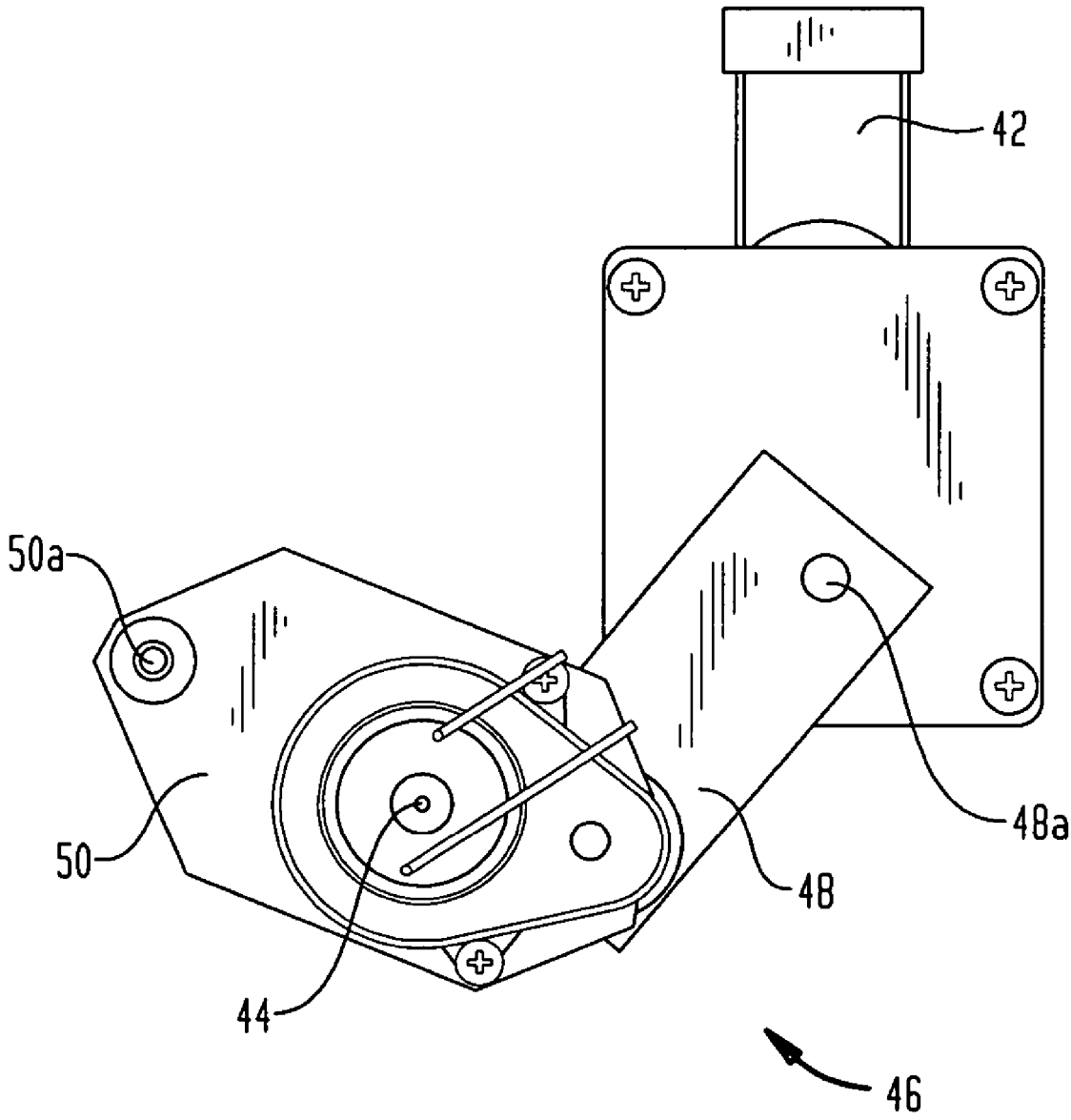
FIG. 5 is an enlarged view of the oscillating motor assembly shown in FIG. 4, in an assembled condition.

First motor 42 may be any electric motor capable of vertically rotating yoke assembly 24 about pivot point 40. As best shown in FIGS. 4 and 5, first motor 42 is mechanically coupled to yoke assembly 24 by cam assembly 46. First motor 42 is particularly arranged so as to rotate yoke assembly 42 to a first, nominal vertical throwing angle. This nominal shooting angle determines the base angle at which the balls are projected in a vertical or up and down direction. In operation, this nominal throwing angle is generally set to a fixed, desired value and is then slightly varied by the second motor 44 as will be discussed further below. For instance, the nominal throwing angle can be set so that balls projected from machine 10 are projected vertically over the net of a tennis court at a desired height and into the opposite side from which machine 10 is placed.

FIGS. 2 and 3 depict yoke assembly 24 in two different nominal vertical throwing angle positions, with FIG. 3 showing a greater nominal vertical throwing angle so that balls projected by machine 10 will follow a more vertical trajectory. This can be best seen by following the trajectory of arrow A in each of these figures. First motor 42 is preferably adapted for the relatively larger amount of vertical rotation of yoke assembly 24 required in order to initially set this nominal vertical throwing angle. Thus, motor 42 should be capable of a more sweeping rotation of yoke assembly 24.

Second motor 44 is preferably a similar electric motor to that of first motor 42, but may be smaller in size and power. Second motor 44 and cam assembly 46 are preferably configured and arranged so that relatively small variations in both the positive and negative vertical rotational directions with respect to the nominal throwing angle can be achieved to create fine vertical oscillation adjustments. Essentially, this amounts to the yoke assembly 24 being moved only a small amount of degrees in the positive and negative directions about pivot point 40. For example, certain embodiment machines 10 can be adapted for allowing approximately 4 degrees of rotation (2 degrees in each direction) about pivot point 40 upon the operation of second motor 44. This minute movement is best shown by arrows A' and A" of FIGS. 2 and 3 (with arrow A' representing movement in the positive or upward direction and arrow A" representing movement in the negative or downward direction). However, it is noted that second motor 44 and/or cam assembly 46 may be configured to provide any amount of movement to yoke assembly 24. The major difference between first motor 42 and second motor 44 and their respective cooperation with yoke assembly 24 is that operation of first motor 42 will more broadly rotate the yoke assembly, while operation of second motor 44 will provide relatively small or rotational adjustments. Nevertheless, both types of rotation are achieved by simply operating the respective motors without the use of complicated motor controls or the like. First motor 42 is operated to rotate a drive shaft in one direction or the other and second motor 44 is operated to rotate a drive shaft in one direction during use of machine 10.

Figure 6:
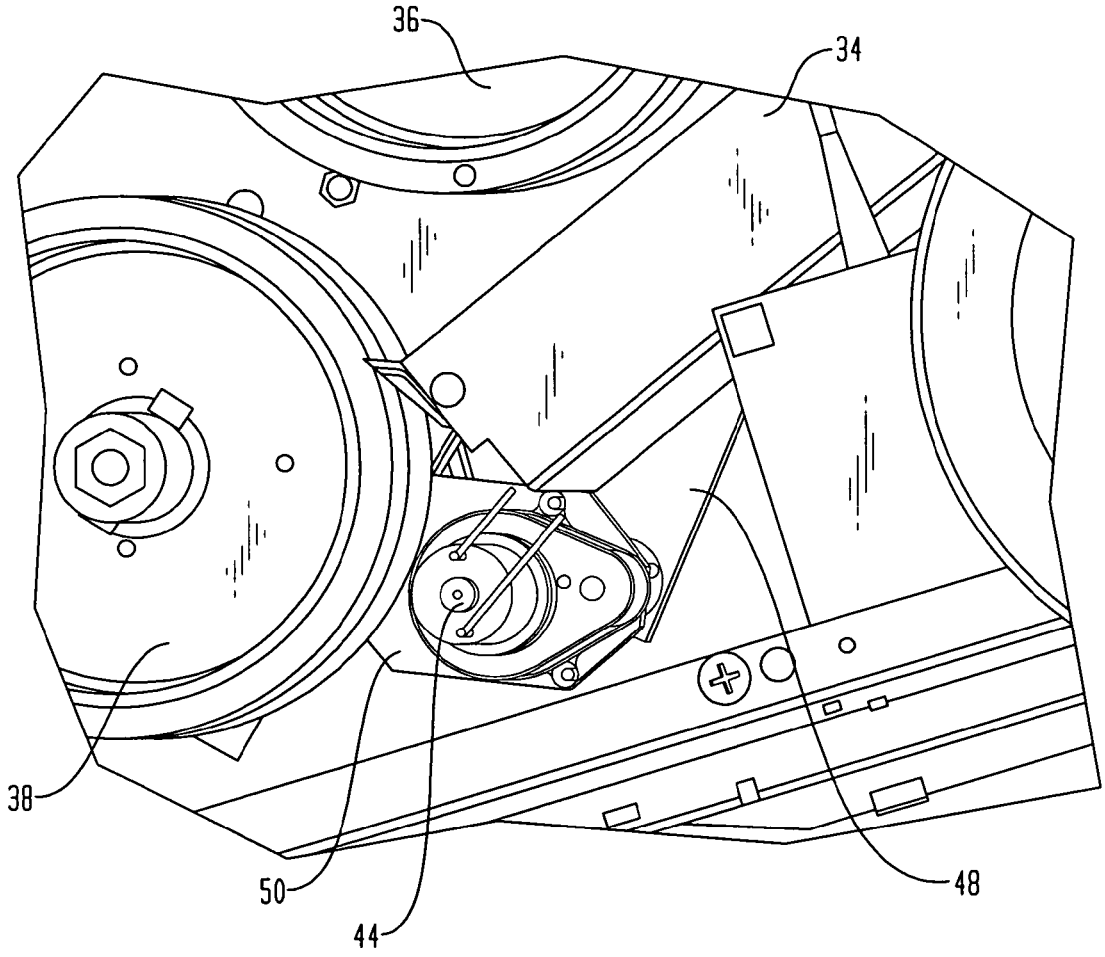
FIG. 6 is an enlarged right side cut-away view of the ball throwing machine shown in FIG. 1, depicting the oscillating motor assembly and its cooperation with other elements of the ball throwing machine.
Figure 7:
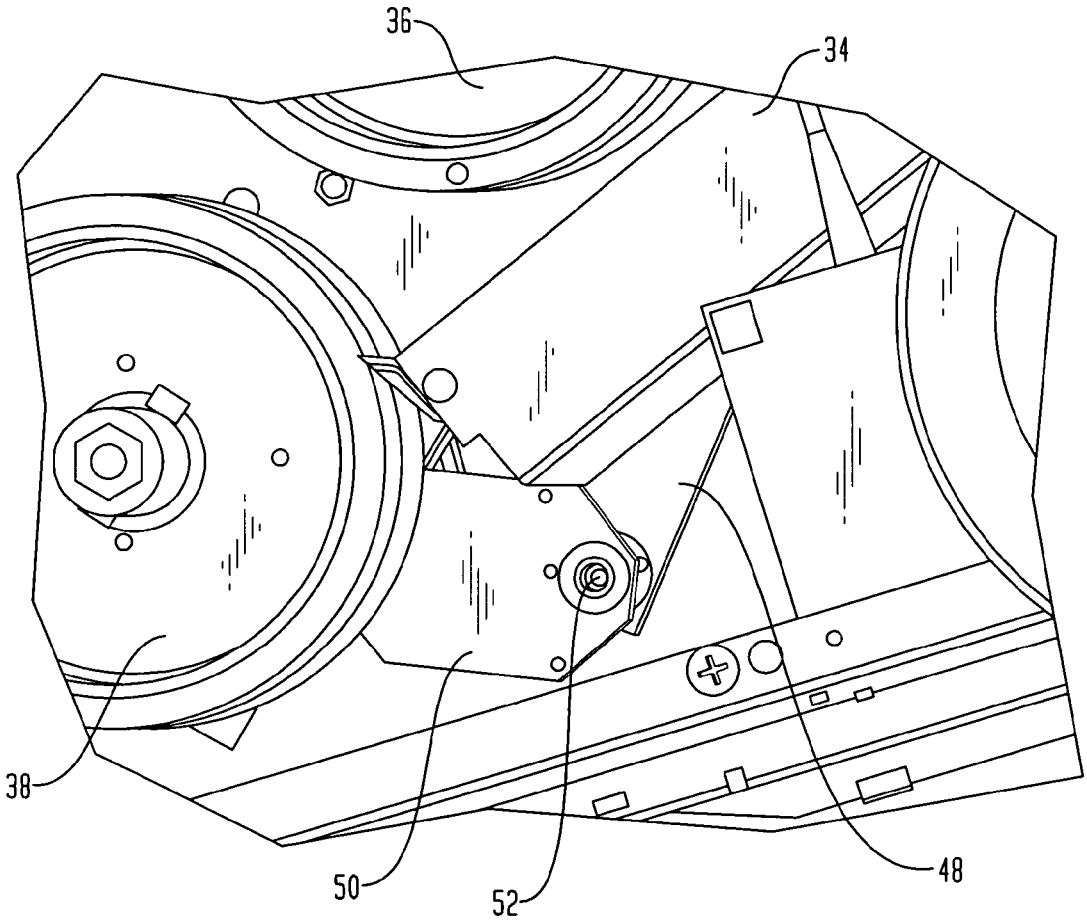
FIG. 7 is an enlarged right side cut-away view of the ball throwing machine shown in FIG. 1, depicting the oscillating motor assembly and its cooperation with other elements of the ball throwing machine, with one oscillating motor removed.

As best shown in FIGS. 3 and 4, cam assembly 46 is preferably constructed of several components, including a first linkage portion 48, a second linkage portion 50 and a rotatable cam 52, which is of an offset design. It is noted that other elements may also be included in cam assembly 46, such as screws, bolts, washers and the like. First linkage portion 48 is preferably connected directly to first motor 42 at point 48*a* and to cam 52 at point 48*b*. On the other hand, second linkage portion 50 of cam assembly 46 is preferably connected directly to yoke assembly 24 at point 50*a* and to both second motor 44 and cam 52 at point 50*b*. The cooperation between cam assembly 46 and yoke assembly 24 is shown in FIGS. 6 and 7. As best shown in FIG. 5, this configuration also provides a connection between first and second linkage portions 48, 50 at cam 52.

As discussed above, first motor 42 allows for the sweeping rotation of yoke assembly 24 to set the nominal throwing angle. In operation, first motor 42 rotates first linkage portion 48 and therefore second linkage portion 50. Absent operation of second motor 44, first and second linkage portions 48 and 50 act as a unitary arm and rotation of such by first motor 42 is ultimately translated to yoke assembly 24 at point 50*a*.

In addition, the cooperation between second motor 44, second linkage portion 50 and cam 52 allows for smaller rotation with respect to the nominal vertical throwing angle upon operation of second motor 44. This results in the aforementioned fine oscillation adjustment of yoke assembly 24. The offset design of cam 52 preferably allows for fine oscillating motion of the yoke assembly 24 by mechanically oscillating second linkage portion 50 as second motor 44 rotates cam 52 within it. Namely, cam 52 is driven by a drive shaft of second motor 44 so that the yoke assembly is rotated up and down in each direction. It should be understood that the rotation of offset cam 52 in one direction will provide both up and down directional variation (best shown by arrows A' and A" in FIGS. 2 and 3). In certain preferred embodiments, the cam is set to move the yoke assembly by plus or minus two degrees. Thus, one complete rotation of second motor 44 will cause yoke assembly 24 to rotate two degrees in the positive direction and two degrees in the negative direction with respect to the nominal throwing angle. This is useful, for example, in varying the depth of the particular shot on the tennis court. However, cam 52 or the other components of cam assembly 46 can be designed to allow for oscillation over other ranges.

In addition to the particular shape and design of cam 52 as shown in the drawings, other cam configurations can be employed to cause the oscillation of the yoke assembly. For example, the cam can be shaped to comprise a wafer shape having an offset drive shaft hole. Such a cam would preferably rotate within the first motor link while the second motor link would have only a clearance hole for the motor shaft to project through into the cam hole. In this case, the cam would still mount to the second link but be held inside the cam hole via a device such as a holding pin protruding through the cam and shaft radially, holding them together. In addition, it is noted that yoke assembly may be rotated such that it is not merely raised or lowered in a vertical direction. For example, the present invention may be configured so that the cooperation between the motor assembly and linkage or cam assembly can provide fine oscillation of yoke assembly 24 in the left and right directions, or in a direction including both up and down and left and right directional components.

The present invention also allows for the addition of second motor 44 by the user or manufacturer as a further option. In other words, machines 10, in accordance with the present invention, may be manufactured and sold having only a first motor 42. Thus, such machines would preferably only be capable of setting the initial nominal throwing angle, while also varying the left and right throwing direction. However, should a purchaser thereafter decide that oscillation throwing would be a useful feature to have; second motor 44 could be installed to activate such a feature. Therefore, general operation of machine 10 is preferably not dependent upon the inclusion of all of the above components and thus different models may be offered. In addition, other machines 10 may be manufactured without the above described left and right directional variation capabilities. Once again though, such a feature could be added subsequent to manufacture. Typically, absent second motor 44, cam 52 would simply act as a pivot point. Upon installation of second motor 44, cam 52 would be activated to cause oscillation. Preferably, cam 52 is held in place separately from motor 44, and thus the addition of the motor can be done after market.

In one example of operation of machines designed for use in throwing tennis balls (like that shown in the figures), a user places ball throwing machine 10 on a first side of the tennis court, opposite to the second side where the user will be located. The user then operates first motor 42 (such as via a control panel) to set the nominal vertical throwing angle of yoke assembly 24. As mentioned above, this angle determines the vertical direction of the projection and can be set by the user such that the tennis balls land in a desired nominal depth into the other side of the tennis court. Next, the user starts the second or oscillation motor 44 to begin the vertical oscillation of yoke assembly 24. This second level oscillation causes the tennis balls to land in the opposite side of the court at different short and long distances. It is noted that the cooperation of all of the components of cam assembly 46 allows second motor 44 to merely continuously run in one direction to provide this oscillation throwing. Thus, there is no need for a complicated electronic circuitry system control or other complicated ways for varying the operation of second motor 44. The distances are essentially adjusted based on the rotation speed of second motor 44 and timing of when the ball is dropped from hopper 16 through chute 34 into throwing wheels 36 and 38. The user may further adjust machine 10 via first motor 42 to change the vertical angle of yoke assembly 12 at any time to set a different desired nominal throwing angle as well as adjust the left and right trajectory of the shots.

While the particular embodiment of ball throwing machine 10 depicted in the figures is constructed and configured to throw, project or shoot tennis balls, it should be understood that similar designs may be employed for throwing other types of balls, including but not limited to baseballs, softballs, ping-pong balls, soccer balls, footballs or the like. Thus, those of ordinary skill in the art could also modify many different types of ball throwing machines to incorporate the present invention. In addition, although one particular design tennis ball throwing machine is shown in the figures as an example, it should be noted that the present invention is not limited to this specific example. For instance, the present invention may vary in aesthetic appearance, as well as in the particular accessories it employs. For example, machine 10 as shown in FIG. 1, includes a top loading hopper 12. However, it is noted that certain designs may not include such an element. In another example, a differently shaped machine 10 can be used without straying from the benefits and aims of the present invention.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised and employed without departing from the spirit and scope of the present invention as defined by the appended claims.

The invention claimed is:

1. A ball throwing machine comprising:

a vertically movable yoke assembly for throwing balls at different vertical throwing angles; and a motor assembly mechanically coupled to the yoke assembly for vertically moving the yoke assembly, wherein the motor assembly includes:

a first motor, a second motor, and a linkage assembly having a first linkage portion, a second linkage portion, and an offset cam connected to one of the first and second linkage portions, the linkage assembly connecting the first and second motors to the yoke assembly, the first motor being capable of vertically moving the yoke assembly to a nominal throwing angle and the second motor being capable of vertically oscillating the yoke assembly in both positive and negative directions from the nominal throwing angle.

2. The ball throwing machine according to claim 1, wherein the yoke assembly further includes at least two throwing wheels for throwing balls from the ball throwing machine.

3. The ball throwing machine according to claim 1, wherein the yoke assembly further includes a pneumatic cannon for throwing balls from the ball throwing machine.

4. The ball throwing machine according to claim 1, wherein the yoke assembly further includes means for throwing balls from the machine.

5. The ball throwing machine according to claim 1, wherein operation of the second motor rotates the cam to provide the oscillation of the yoke assembly in both positive and negative directions from the nominal throwing angle.

6. The ball throwing machine according to claim 5, wherein operation of the second motor includes rotating a drive shaft in a single direction.

7. The ball throwing machine according to claim 6, wherein the operation of the second motor is capable of oscillating the yoke assembly between a range of plus and minus two degrees from the nominal throwing angle.

8. The ball throwing machine according to claim 1, wherein the linkage assembly further includes a third linkage portion having an offset drive shaft hole.

9. The ball throwing machine according to claim 8, wherein operation of the second motor rotates the third linkage portion to provide the oscillation of the yoke assembly in both positive and negative directions from the nominal throwing angle.

10. The ball throwing machine according to claim 1, further comprising a third motor for moving the yoke assembly in left and right directions.

11. A tennis ball throwing machine comprising:

a housing including an opening sized to allow tennis balls to pass therethrough;

a hopper for feeding tennis balls into the housing;

a yoke assembly located in the housing, the yoke assembly including at least two throwing wheels for throwing tennis balls from the tennis ball throwing machine; and a motor assembly adapted to vertically move the yoke assembly with respect to the housing, the motor assembly including a first motor, a first linkage mechanism connected to the first motor, a cam connected to the first linkage mechanism, a second linkage mechanism connected to the cam and the yoke assembly, and a second motor connected to the cam and the second linkage mechanism, wherein operation of the first motor is capable of vertically moving the yoke assembly to a nominal throwing angle and operation of the second motor is capable of vertically oscillating the yoke assembly in both positive and negative directions with respect to the nominal throwing angle.

12. The tennis ball throwing machine according to claim 11, wherein the cam is of an offset shape.

13. The tennis ball throwing machine according to claim 12, wherein the operation of the second motor includes rotating a drive shaft in a single direction.

14. The tennis ball throwing machine according to claim 13, wherein the operation of the second motor is capable of oscillating the yoke assembly between a range of plus and minus two degrees with respect to the nominal throwing angle.

15. The tennis ball throwing machine according to claim 11, further comprising a third motor for moving the yoke assembly in left and right directions.

16. A method of throwing balls comprising:

providing a ball throwing machine having a movable yoke assembly a motor assembly;

operating a first motor to move the yoke assembly to a nominal throwing angle;

operating a second motor to oscillate the yoke assembly in both positive and negative directions with respect to the nominal throwing angle, wherein operation of the second motor includes rotating an offset shaped cam; and throwing balls from the ball throwing machine, wherein operation of the second motor includes rotating a drive shaft in a single direction.

17. The method according to claim 16, further including rotating the yoke assembly in left and right directions.

18. The method according to claim 16, wherein operation of the second motor includes oscillating the yoke assembly between a range of plus and minus two degrees from the nominal throwing angle.

* * * * *